United States Patent [19]

Johnson et al.

[11] 4,018,358

[45] Apr. 19, 1977

[54] CASSETTE PILL STORING, DISPENSING AND COUNTING MACHINE

[75] Inventors: Robert D. Johnson; John W. Havener; Franklin W. Reyner, Jr.; Loren K. Whitver; Norman W. Kilburn, all of West Union; Jack M. Hoglan, Independence, all of Iowa

[73] Assignee: Pharmaceutical Innovators, Ltd., West Union, Iowa

[22] Filed: Sept. 18, 1975

[21] Appl. No.: 607,782

[52] U.S. Cl. ..... 221/7; 221/13; 221/197; 221/211

[51] Int. Cl.² ..... B65B 57/20

[58] Field of Search ..... 221/7, 13, 197, 203, 221/206, 207, 211; 53/59 R, 78; 133/8 R

[56] References Cited

UNITED STATES PATENTS

| | | | |
|---|---|---|---|
| 1,502,053 | 7/1924 | Nordstrom | 221/203 X |
| 2,665,184 | 1/1954 | Hord | 221/197 X |
| 2,692,705 | 10/1954 | Marihart | 221/203 X |
| 3,486,658 | 12/1969 | Cheslak et al. | 221/197 |
| 3,587,921 | 6/1971 | Giangarra et al. | 221/197 X |
| 3,796,346 | 3/1974 | Ribouleau | 221/211 |
| 3,837,139 | 9/1974 | Roseberg | 221/7 X |

*Primary Examiner*—Robert B. Reeves
*Assistant Examiner*—Francis J. Bartuska
*Attorney, Agent, or Firm*—Zarley, McKee, Thomte & Voorhees

[57] ABSTRACT

Different types of pills are stored in separate cassettes which may be operated by a dispensing machine for dispensing from the cassette into a vial. The dispensing machine provides a vacuum supply and a drive for operating a wheel in the cassette having a series of openings annularly arranged to pick up pills in the bottom of the cassette and carry them to a discharge opening under the vacuum pressure. A separator wall extending across the line of travel of the holes carrying pills deflects the pills through the discharge opening. A gauge is adjustable to overlie a portion of the openings in the wheel to vary the opening size so that only a single pill is carried by each opening. A photoelectric cell triggered by a fiber optic scanner at the discharge opening counts each pill. An agitator turns with the conveying wheel to break up pills bridged together. A switch is utilized to set an electronic counter to the number of pills desired. This counter then successively counts down until it reaches zero at which point the machine stops.

26 Claims, 11 Drawing Figures

CASSETTE PILL STORING, DISPENSING AND COUNTING MACHINE

BACKGROUND OF THE INVENTION

The dispensing of pills is ordinarily done on a manual basis with the pharmacist counting them out into a vial from a storage container. This is a tedious and time-consuming job and may be inaccurate. Accordingly, an automatic machine is desired that will dispense pill quickly, efficiently and accurately thereby freeing the pharmacist for other activities.

SUMMARY OF THE INVENTION

The pharmacist will place quantities of each of his pills into separate cassettes arranged in bookshelf fashion next to the pill dispensing and counting machine of this invention. The cassette is placed on the machine where it then is in communication with a vacuum source in the machine and a drive wheel for operating a conveying wheel in the cassette which carries pills from the bottom of the cassette to a discharge opening which is above the vial to be delivered to the customer. A photoelectric cell senses each pill carried to the discharge opening via a fiber optic scanner and counts it on an electronic counter which will continue counting pills until the predetermined number set on the counter has decreased to zero whereby the machine will then shut down and an accurate number of pills will have been dispensed while the pharmacist is preparing the label for the vial.

The pills in the cassettes are maintained fresh while they are being stored in that the conveying openings on the wheel are closed by an annular ring which is pulled away from the openings when the vacuum is applied to the wheel. Air is drawn into the cartridge through a top opening normally closed by a door which is opened by engagement with a plate on the machine. A second door is also opened normally closing a passageway leading to the discharge opening. These two doors are integrally connected to move together to open and close their respective openings. The fiber optic scanner also registers on the pills moving past it by being positioned just outside the top opening in the cassette. This top opening is also used for filling the cassette. The wall forming a passageway to the discharge opening also extends across the line of travel of the openings in the wheel thereby deflecting the pills into the discharge passageway for discharge through the discharge opening.

The wheel in the cassette is driven by an annular wall engaging the flat surface of the wheel and the wall forms with the wheel a vacuum chamber. The suction applied to the wheel maintains frictional contact between the driving wall and the driven wheel. A centering pin is provided on the machine for being received in the hub of the cartridge wheel. Openings are provided around the centering pin for communicating the vacuum to the vacuum chamber and to the conveying openings in the wheel.

DESCRIPTION OF THE INVENTION

Figure 1:
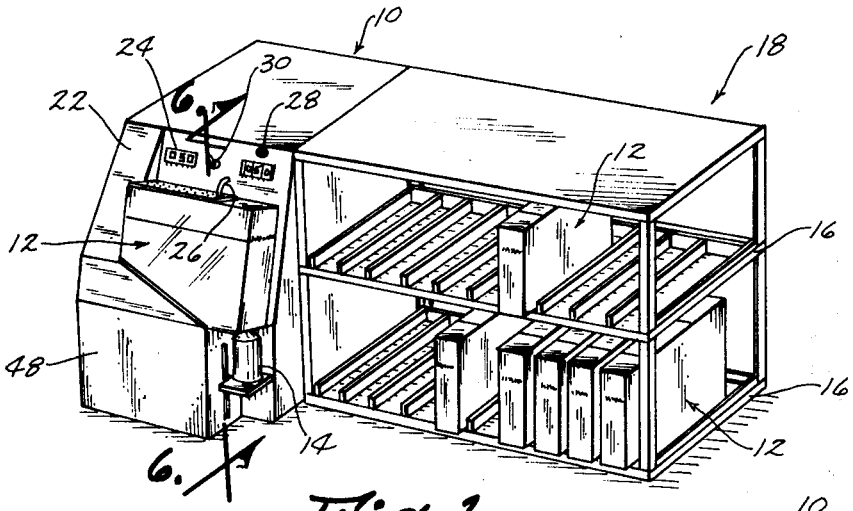
FIG. 1 is a perspective view of the cassette pill storing, dispensing and counting machine and cassette storage rack.
Figure 2:
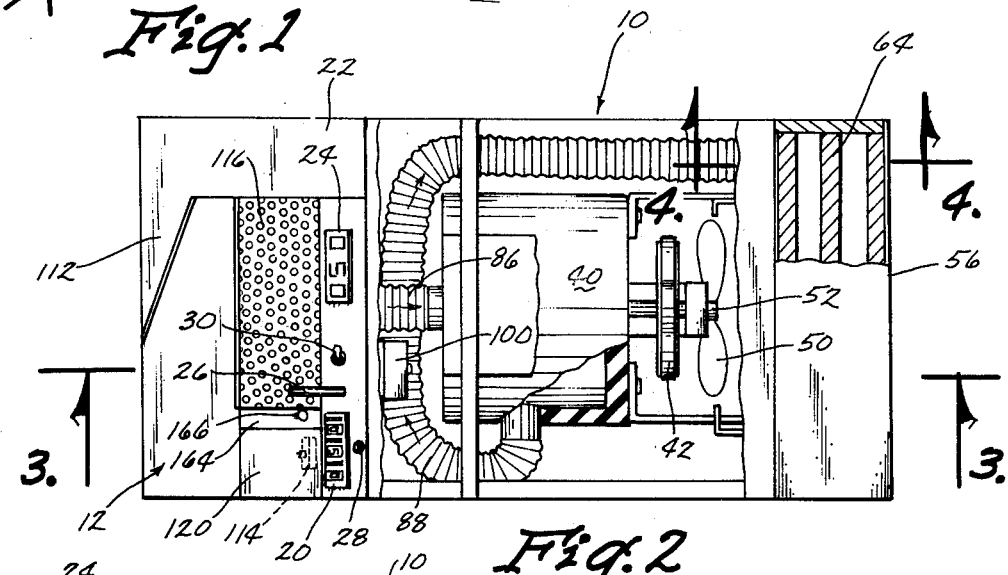
FIG. 2 is a fragmentary top plan view of the machine only.

The pill dispensing and counting machine of this invention is referred to generally in FIG. 1 by the reference numeral 10 and includes a pill cassette 12 from which pills are dispensed into a vial 14. The pharmacist will have each of his different pills stored in individual cassettes 12 on storage shelf 16 of a rack 18 preferably positioned adjacent the machine 10 for convenient transfer between storage and dispensing on the machine.

A mechanical binary coded decimal three digit switch is employed on the face 22 of the machine 10 for setting the number of pills desired while an electronic L E D display counter 24 will count out the number of pills being dispensed in response to a signal from a fiber optic scanner triggering a photoelectric cell 26 which reads pills actually passing out the discharge opening of the cassette. When the number on the L E D display has decreased to zero, the machine will shut down, further confirming that the exact number of pills has been dispensed. A start button 28 and a master or main switch and combined circuit breaker 30 are also provided on the face 22 of the machine.

Figure 6:
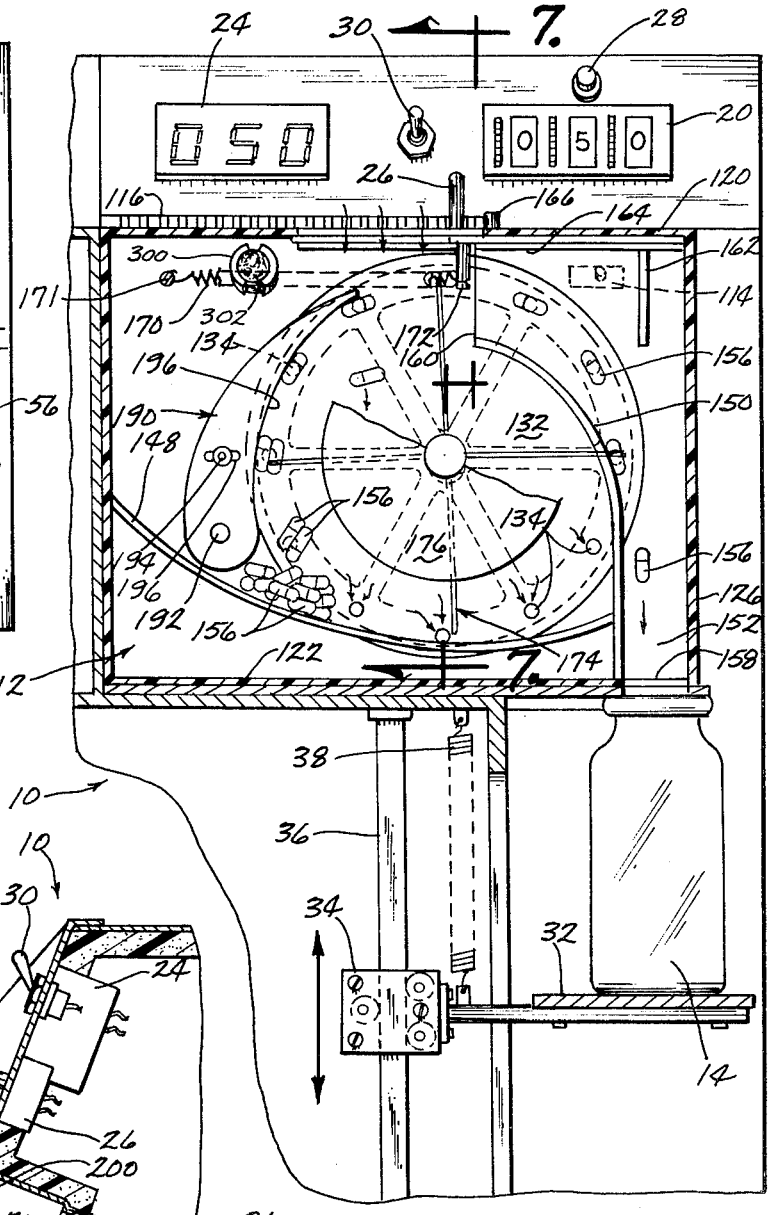
FIG. 6 is a cross sectional view taken along line 6 — 6 in FIG. 1.

The vial 14, as seen in FIG. 6, is placed on a shelf 32 movably carried by a trolley arrangement 34 on a vertically disposed rail 36. The shelf 32 is biased upwardly by a spring 38 to thereby maintain the vial 14 in communication with the discharge opening of the cassette.

Figure 3:
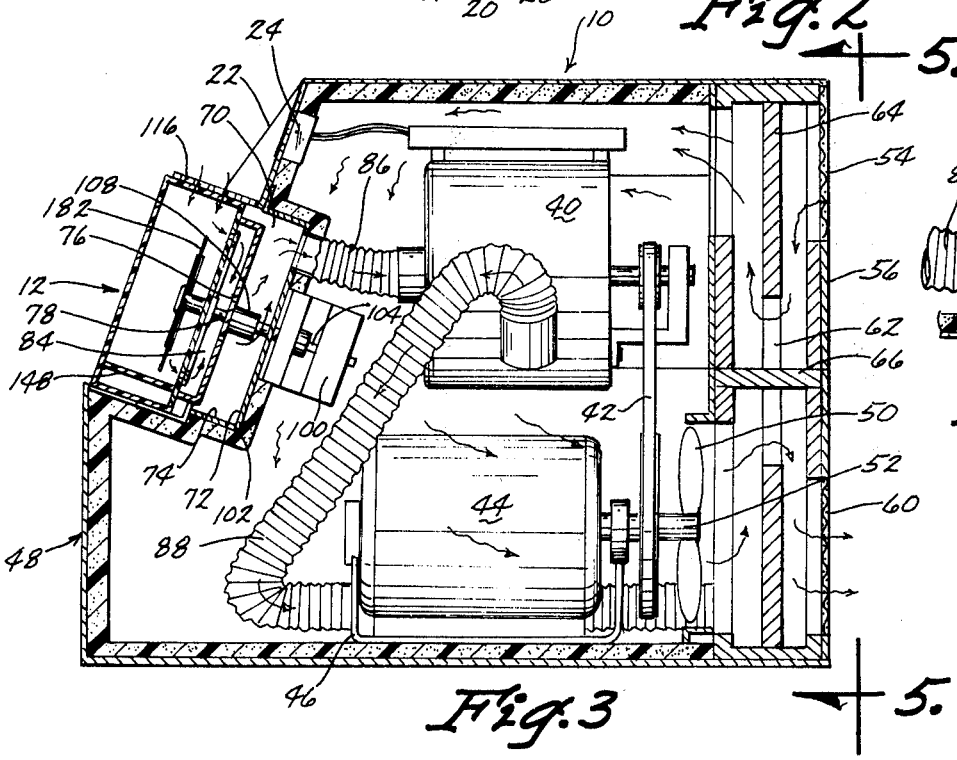
FIG. 3 is a cross sectional view taken along line 3 — 3 in FIG. 2.
Figure 5:
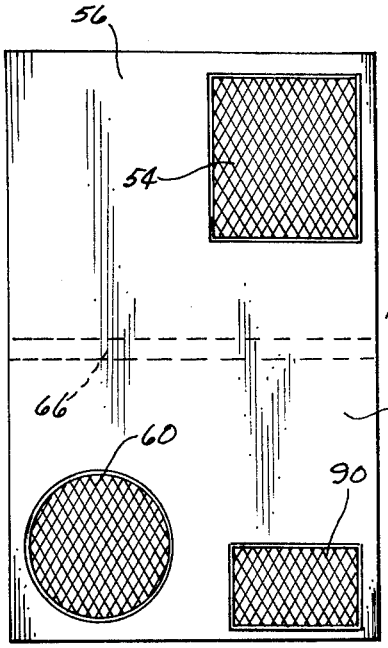
FIG. 5 is a rear end elevation view of the dispensing machine.

The dispensing machine comprises two basic mechanical systems used in conjunction with the cassette during the dispensing of pills. The first system is for providing a vacuum to the cassette. The second system is for driving the cassette. The vacuum system includes a fan 40 operated by a belt 42 connected to a motor 44 mounted on a bracket 46 secured to the bottom of the machine housing 48. A cooling fan 50 is provided on the motor shaft 52 for drawing air in through an opening 54, as seen in FIG. 5, on the back side 56 of the machine housing 48. The air is then exhausted through the opening 60 in the back wall 56. As seen in FIG. 3, the air drawn through the opening 54 is caused to flow downwardly through an opening 63 in a baffle 64 and then back to the top of the enclosure 48 towards the front end and then downwardly around the motor 44 as seen by the arrows where it is finally exhausted through the bottom opening 60 directly opposite the fan 50. A wall 66 in the baffle chamber divides the baffle chamber into top and bottom baffle chambers to assist in maintaining the desired circulation of the air as described.

Figure 4:
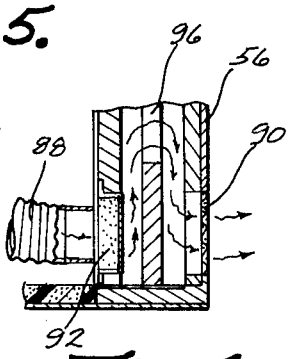
FIG. 4 is a cross sectional view taken along line 4 — 4 in FIG. 2.
Figure 7:
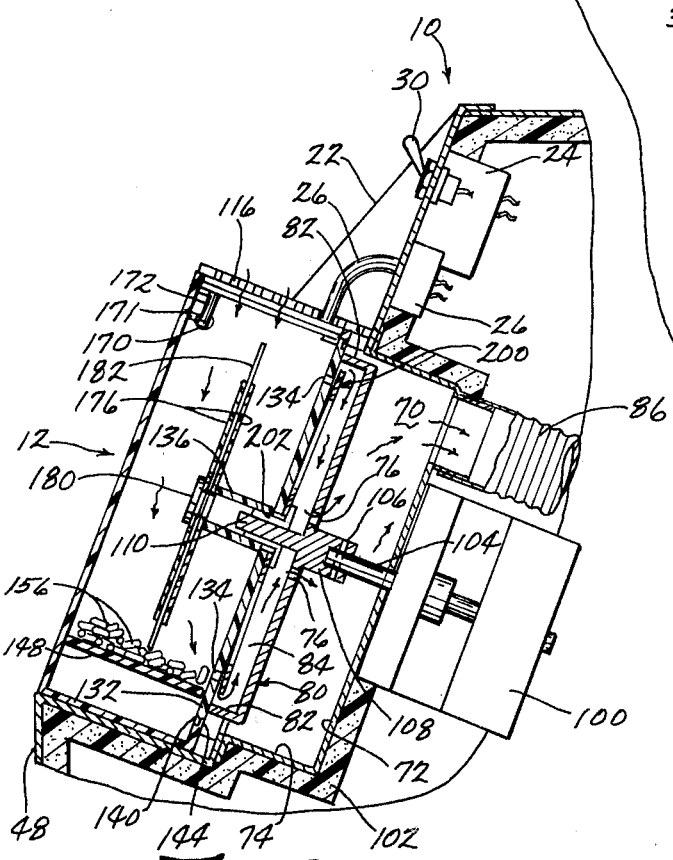
FIG. 7 is a cross sectional view taken along line 7 — 7 in FIG. 6.
Figure 8:
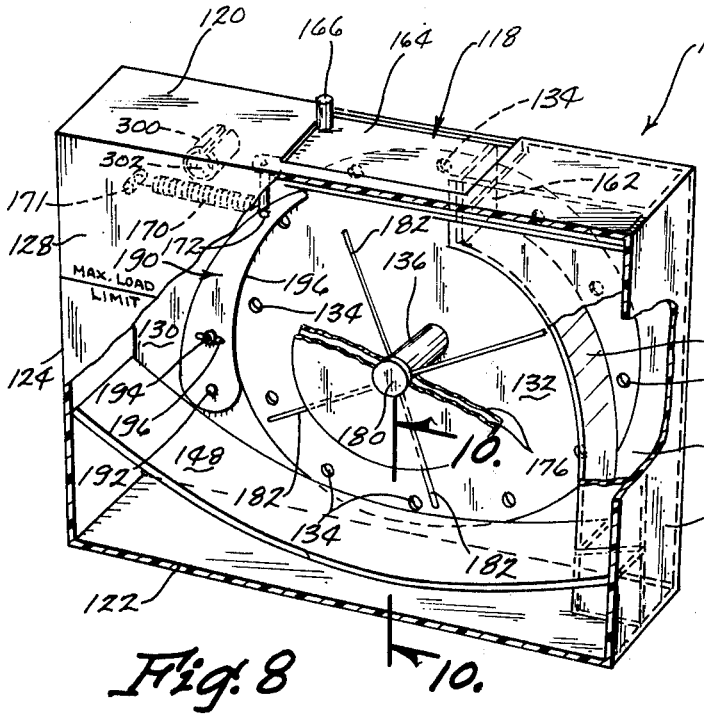
FIG. 8 is a perspective view of the cassette.

The air for the vacuum fan 40 is drawn from a vacuum chamber 70 formed by wall 72 and an upstanding wall 74. The chamber 74 is in turn in communication through a plurality of openings 76 around a drive shaft 78 in a dish-like vacuum drive wheel 80 having an upstanding wall 82. Thus, a second vacuum chamber 84 is defined by the vacuum drive wheel 80 and the cassette 12 which will be defined hereinafter. Accordingly, the air thus flows from the atmosphere through the cassette through the vacuum chamber 84 into the vacuum chamber 70 then into a tube 86 connected to the fan 40 where it is then exhausted to a tube 88 which communicates with the atmosphere at the rear of the machine, as seen in FIG. 5, through the exhaust opening 90 having a filter 92. It is seen that the air is circulated in FIG. 4 through a baffle opening 96 to the outlet opening 90 on the back side of the machine. The second system for driving the cassette includes a motor 100 mounted on a recess wall 102 and having a shaft 104 motor 100 mounted on a recess wall 102 and having a shaft 104 connected by a pin 106 to a centering hub 108 having an outwardly extending finger 110. The vacuum drive wheel 80 is connected integrally to the hub 108 to drive the cassette through frictional engagement along the outer edge of the wall 82 with the back side of the wheel of the cassette hereinafter described. It is noted that, as shown in FIG. 7, there is no driving action occurring between the cassette and the centering finger 110, thus simplifying the structure. The motor 100 is preferably operated at 25 r.p.m.

The cassette, generally referred to by the reference numeral 12, will now be described. It is held in position on the front of the machine, as seen in FIG. 1, by a wall portion 112, engaging the front face of the cassette. Also, a micro interlock switch 114 is provided between the cassette and the front face 22 of the machine to insure that the machine does not operate until a cassette is put in its proper position for operation. A perforated plate 116 extends forwardly from the face 22 of the machine and serves to operate the access door 118 in the top wall 120 of the cassette 12. The perforations in the plate 116 serve to allow air to enter the cassette while keeping the pills from being ejected therefrom.

In addition to the top wall 120 of the cassette 12, a bottom wall 122 interconnects opposite end walls 124 and 126. The cassette further includes opposite side walls 128 and 130.

Figure 10:
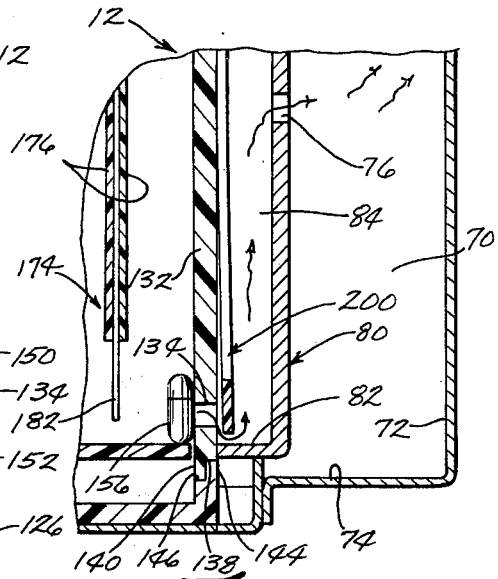
FIG. 10 is a cross sectional view taken along line 10 — 10 in FIG. 8.
Figure 9:
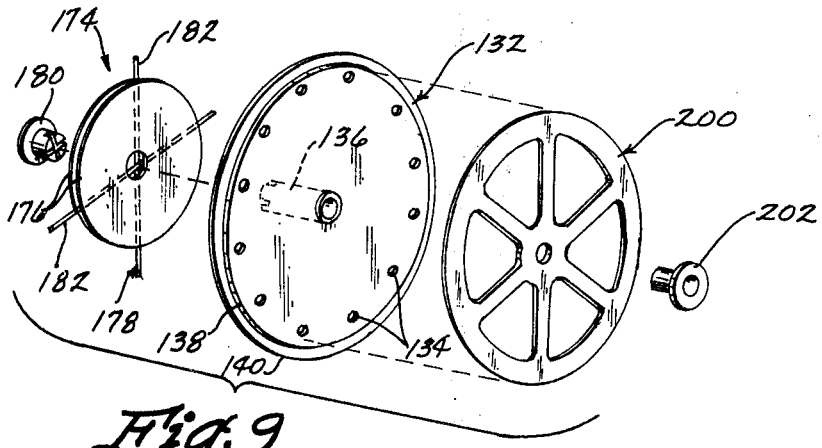
FIG. 9 is an exploded view of the cassette.
Figure 11:
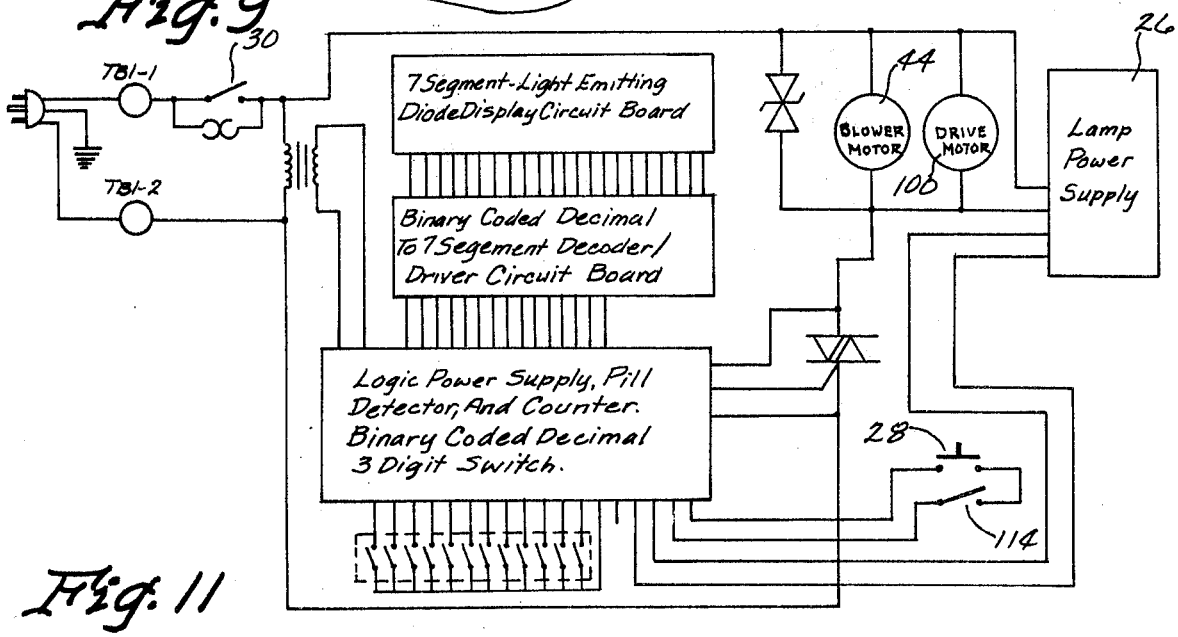
FIG. 11 is an electrical schematic drawing of the electrical circuitry for operating the dispensing machine.

The side wall 130 includes the pill conveying wheel 132 which includes a plurality of pill conveying openings 134 coaxially arranged around the disc-like wheel and its axial center of rotation which extends through a spacer post 136 which receives the centering finger 110 on the drive shaft 104 of the motor 100. The outer peripheral edge of the disc-like wheel 132 includes a shoulder 138 and an outwardly extending annular flange 140 which matingly engages an oppositely disposed flange 144 and a shoulder 146 which defines an opening in the cassette 130, as seen in FIG. 10. Thus it is seen that the disc wheel 132 is retained in the wall 130. It is also seen in FIG. 10 that the upstanding wall 82 of the vacuum drive wheel 80 engages the disc wheel 132 between the openings 134 and the outer peripheral edge. Contact is maintained by the vacuum applied to the wheel. The wheel 132 is limited against inward travel into the cassette by a concave wall 148 extending upwardly between the opposite side walls 128 and 130 and a separator and discharge passageway wall 150. The concave wall 148 functions to keep the pills funneled to the area of the wheel to be picked up by the wheel and discharged.

The separator and discharge passageway wall 150 is seen in FIG. 6 to extend upwardly from the bottom wall 122 where it is spaced inwardly from the end wall 126 to form a discharge passageway 152. The wall 150 is curved upwardly and inwardly across the line of travel 154 of the pills 156 carried on the wheel 132 and thus serves to separate the pills from the wheel and into the passageway 152 for discharge out the discharge opening 158 into the vial 14. The upper end of the wall 150 is spaced downwardly from the top wall 120 and thus forms an opening 160 closable by a movable door 162 extending downwardly from a horizontally disposed door 164 positioned to close the access opening 118 in the top wall 120 of the cassette. An upstanding actuating pin 166 is carried on the door 164 and is engaged by the perforated plate 116 when the cassette is in its position of use as seen in FIG. 6, thus sliding the doors 164 and 162 to the right and thus providing the openings 160 and 118. A spring 170 inside the cassette is connected to a pin 171 on the inside of wall 128 and its other end is connected to the downwardly extending pin 172 on the bottom side of the door 164 for normally maintaining the doors in their closed position sealing the pills while in storage from the atmosphere.

Agitation of the pills 156 on the concave wall 148 is accomplished by an agitator 174 rotatable with the wheel 132 by virtue of a pair of discs 176 being disposed in clamping relationship on opposite sides of a pair of crossed flexible elements 178 secured to the spacer post 136 by a cap element 180. It is seen that the outer ends 182 of the elements 178 extend beyond the outer peripheral edges of the discs 176 thereby being free to flex and kick the pills upwardly as the elements turn clockwise through the heap of pills on the wall 148. It is desired to break up any bridging of the pills at the top surface such that they may be drawn by the vacuum pressure onto the holes 134 singularly. Thus the discs 176 give rigidity to the inner ends of the agitating elements 178.

Each cassette will be adjusted through operation of a gauge 190 for the particular pills or the like to be stored and dispensed therefrom. The size of the opening 134 is such that it will accommodate any size pill but that opening may be too large for certain pills and thus may carry more than one pill unless the gauge 190 is operated to restrict the opening so that only one pill will be carried. Accordingly, the gauge 190 is pivotally connected to the wall 130 on the inner surface thereof by a pin 192, and a lock bolt 194 extends through an elongated slot 196 to allow pivotal adjustment of the gauge towards and away from the openings 134 in the wheel 132. The gauge 190 is concave to extend across the openings 134 to give the maximum amount of adjustment capability. It is only necessary that one of the openings be partially covered by the gauge. The concave edge 196 corresponds in shape to the circular outer periphery of the openings 134. Once the gauge is set it can remain set indefinitely. If too much of the opening is covered, then certain openings will not carry pills, while if too little of the opening is exposed certain openings may carry more than one pill and the photoelectric cell will read two pills as one. Thus, brief experimentation will indicate when the gauge is set correctly.

As discussed previously, the cassette is sealed when in storage and the openings 134 are sealed by a ring 200 adapted to overlay the openings when not in communication with the vacuum. The ring 200 is made of a material which is resilient and allows the vacuum to pull the ring away from the openings 134 to establish communication with the inside of the cassette through the openings. The ring 200 is secured to the spacer post 136 by a coaxial cap 202. The inside of the cassette is maintained moisture free by the inclusion of a desiccant holder 300 which includes a roll of desiccant material 302, as seen in FIG. 6.

Thus in operation it is seen that the various pills, tablets, and the like of the pharmacists are stored in their own cassette 12 on the shelf 16 of the rack 18 adjacent the dispensing machine 10. The gauge 190 in each of them has been adjusted to allow only one pill to be carried by each hole 134 in the wheel 132. All access into the cassette is sealed when in storage by the ring 200 over the holes 134 and the doors 162 and 164 closing the inlet opening 160 to the discharge passageway 152 and the access opening 118 in the top of the cassette wall 120.

The number of pills desired is set on the switch 20 and with the cassette 12 in place on the face of the machine the interlock switch 114 will be closed by the cassette and the start button 28 will load the desired number into the electronic counter and start the machine. The main power switch 30 has been previously actuated. The counter 24 will now count out the pills remaining that are being dispensed by the fiber optic actuated photoelectric cell 26 counting each pill that is dispensed into the vial 14. The machine will shut down when the correct number of pills has been dispensed.

Arrows are drawn through the perforated plate 116 down through the access opening 118 in the top wall 120 of the cassette 12 through the pill-carrying openings 134 past the sealing ring 200 through the hole 76 in the driving wheel 80 thence through the chamber 70 and through the pipe 86 to the vacuum fan 40 where the air is then exhausted through the pipe 88 and out through the filtered exhaust opening 90 on the back side of the machine. It is seen that the frictional contact between the upstanding wall 82 of the driving wheel 80 against the pill-conveying wheel 132 is accomplished by the vacuum applied to the wheel 132 and thus no mechanical parts are required to make this connection.

We claim:

1. A cassette pill storing, dispensing and counting machine comprising:

a machine enclosure having one side wall on which a cassette for storing and dispensing pills is positioned, said one side wall having a vacuum source and a wheel driving means, said cassette including a pair of side walls, a pair of end walls and top and bottom walls defining a storage chamber, a rotatable pill conveying wheel engaging said wheel driving means positioned in one of said side walls and including a plurality of openings providing communication between said chamber and the outside vacuum source annularly arranged around the wheel's axis of rotation for holding pills on said wheel under a vacuum from said vacuum source, a discharge opening in communication with said chamber, and a pill separator means positioned to operatively separate said pills from said wheel such that said pills are discharged through said discharge opening upon said wheel having conveyed said pills to said separator means, said wheel driving means having an annular rotating wall having an outer edge engaging said pill conveying wheel and being held in engagement by said vacuum applied to said wheel by said vacuum source.

2. The structure of claim 1 wherein a centering pin is provided on said one side wall for engagement by a hub on said wheel at its axial center.

3. The structure of claim 2 wherein said annular wall is high enough to space said wheel radially inwardly of said annular wall to provide a vacuum chamber between said wheel and said annular wall and said vacuum source is connected to said vacuum chamber for communication with said holes in said wheel.

4. The structure of claim 1 wherein a vial tray is positioned beneath said cassette discharge opening.

5. The structure of claim 1 wherein a photo electric sensor is provided on said enclosure for reading the pills passing into said discharge opening.

6. The structure of claim 5 wherein an electrical power means is provided for operating said wheel and said vacuum and is included in a circuit with a counter and a counter pre-setting switch and motor switching switch means, the pre-setting switch having a predetermined number set on it corresponding to the pills desired and the second counter being responsive to said sensor and decreasing one unit for each pill to register the pills dispensed such that when the pills dispensed equal the number on said pre-setting switch the counter will have decreased to zero opening said switch means and opening the power circuit operating the drive motor and lamp power supply.

7. A cassette for storing and dispensing pills comprising, a cassette including a pair of side walls, a pair of end walls and top and bottom walls defining a storage chamber, a rotatable pill conveying wheel positioned in one of said side walls and including a plurality of openings providing communication between said chamber and the outside annularly arranged around the wheel's axis of rotation for holding pills on said wheel upon a vacuum being applied to said opening from the outside of said chamber, a sealing ring yieldably positioned on the outside over said annularly arranged openings to normally close said openings and upon vacuum being applied to said ring being movable away from said openings to place said chamber in communication with said vacuum, a discharge opening in communication with said chamber, and a pill separator means positioned to operatively separate said pills from said wheel such that said pills are discharged through said discharge opening upon said wheel having conveyed said pills to said separator means.

8. The structure of claim 7 wherein said separator means is further defined as being a wall in said chamber positioned closely adjacent said wheel and across the annular travel path of said pills being conveyed on said wheel whereby said pills are deflected and separated from their respective openings.

9. The structure of claim 8 wherein said separator means is further defined as being a wall which cooperates with said cassette walls to define a discharge passageway from said wheel to said discharge opening.

10. The structure of claim 9 wherein said discharge passageway includes an inlet opening opposite said discharge opening and a normally closed door is positioned in said inlet opening to close said passageway to communication with said chamber.

11. The structure of claim 10 wherein a second door is provided in one of said walls remotely to said plurality of openings in said wheel for normally closing an access opening into said chamber.

12. The structure of claim 11 wherein said first and second doors are operatively interconnected to open and close in unison and spring means is provided for maintaining said doors in their normally closed positions.

13. The structure of claim 12 wherein an upstanding actuator pin is provided on said second door for opening said first and second doors.

14. The structure of claim 12 wherein said separator wall extends in spaced relation to the portion of said top wall and the adjacent end wall and said discharge opening is in said bottom wall and said access opening is on said top wall adjacent said inlet opening to said passageway.

15. The structure of claim 14 wherein an upstanding actuator pin is provided on said second door for opening said first and second doors, said actuator pin being positioned to extend through the plane of said top wall and thereby engage opposite ends of said access opening in said top wall and thereby limit travel of said second door in opposite directions.

16. The structure of claim 7 wherein said chamber includes a bottom wall which is concave upwardly and extends substantially between the opposite end walls to maintain pills in said chamber adjacent said wheel.

17. The structure of claim 7 wherein said wheel is further defined as being a disc having an outer peripheral edge and an annular flange extending from one side of said disc outwardly of said peripheral edge, and said one side wall having said wheel includes an opening having a peripheral edge and said peripheral edges of said disc and said opening in said one wall are in mating engagement with each other with said flange extending on the inside surface of said one wall over and outwardly of said edge in said one wall opening to limit movement of said wheel outwardly through said opening.

18. The structure of claim 1 wherein said ring is secured to said wheel for rotation therewith.

19. The structure of claim 1 wherein said wheel includes a center hub and an axial opening for receiving a guide pin on a driving means for rotating said wheel.

20. The structure of claim 19 wherein said wheel includes an annular track outwardly of said sealing ring for engagement by a driving means for rotating said wheel.

21. The structure of claim 7 wherein a gauge means is provided in said chamber and is movably adjustable to selectively extend across a portion of at least one opening in said wheel near the top of the openings annular travel path above the normal top level of pills adapted to be placed in said chamber whereby each opening may be limited to a single pill during conveying of said pills.

22. The structure of claim 21 wherein said gauge means is further defined as an arm pivotally connected to said end wall and locking means is provided for locking said arm in a desired position.

23. The structure of claim 22 wherein said arm includes a concave edge adjacent said one opening in said wheel for extending across said one opening.

24. The structure of claim 7 wherein said wheel includes agitation means in said chamber rotatable therewith for breaking up bridging between pills.

25. The structure of claim 24 wherein said agitation means includes radially outwardly extending fingers from the axial center of said wheel.

26. The structure of claim 25 wherein said agitation means further includes a pair of discs on opposite sides of said fingers with said fingers having outer ends extending radially outwardly of said discs.

* * * * *